US005199470A

United States Patent [19]

Goldman

[11] Patent Number: 5,199,470

[45] Date of Patent: Apr. 6, 1993

[54] METHOD AND APPARATUS FOR REFILLING INK CARTRIDGES

[75] Inventor: Barry M. Goldman, Waltham, Mass.

[73] Assignee: Graphic Utilities, Inc., Waltham, Mass.

[21] Appl. No.: 702,081

[22] Filed: May 17, 1991

[51] Int. Cl.[5] ..... B65B 3/30

[52] U.S. Cl. ..... 141/1; 141/98; 141/2; 141/26; 206/223; 30/368; 401/198; 401/199; 401/217

[58] Field of Search ..... 141/1, 98, 18, 2, 23, 141/24, 25, 26; 206/223; 30/368; 401/198, 199, 217; 346/140 R, 146

[56] References Cited

U.S. PATENT DOCUMENTS

| | | | |
|---|---|---|---|
| 330,383 | 11/1885 | Devore | 30/366 |
| 4,327,782 | 5/1982 | McKibben et al. | 141/26 |
| 4,855,762 | 8/1989 | Suzuki | 346/140 R |

FOREIGN PATENT DOCUMENTS

| | | | |
|---|---|---|---|
| 0382290 | 10/1923 | Fed. Rep. of Germany | 30/366 |
| 0021534 | 5/1883 | Fed. Rep. of Germany | 30/366 |
| 2098822 | 2/1975 | France | 30/366 |
| 0210739 | 7/1966 | Sweden | 30/366 |

*Primary Examiner*—Ernest G. Cusick
*Attorney, Agent, or Firm*—Lahive & Cockfield

[57] ABSTRACT

A method and apparatus for refilling an ink cartridge include a device for clearing a hole in the cartridge to facilitate the dispensing of ink thereto. The device comprises a handle to which a bit is rigidly affixed so that torque applied to the handle is transmitted to the bit. The bit is arranged to extend along the handle's longitudinal axis. A kit for refilling an ink cartridge includes the aforementioned hole clearing device and a container containing a charge of ink and having a nozzle. The nozzle is formed so that it can pass through the hole cleared by the hole clearing device. In a preferred embodiment, the container is bellows shaped and compressible so that a user can compress the container and increase the rate at which the fresh ink charge is dispensed to the cartridge.

16 Claims, 4 Drawing Sheets

METHOD AND APPARATUS FOR REFILLING INK CARTRIDGES

BACKGROUND OF THE INVENTION

The present invention generally relates to the field of ink jet printers and, in particular, to a method and apparatus for refilling ink cartridges used with such printers.

A significant expense associated with the operation of ink jet printers is the cost of replacing the printer's ink cartridge once the cartridge's charge of ink has been exhausted. Over the lifetime of a printer, this cost can be substantial. The structural components of the ink cartridge, however, are quite durable and capable of far outlasting the cartridge's ink charge. As a result, discarding an ink cartridge simply because its ink charge has been expended is a wasteful, expensive practice.

Recently, the practice of recharging ink cartridges has become popular. In accordance therewith, rather than discarding a cartridge simply because its ink charge has been expended, the cartridge is recharged with a fresh supply of printing ink. Present methods involve dispensing the new charge of ink to the cartridge through a breather port provided in the top of the cartridge. A problem with this practice, however, is that since breather ports are constructed only for the purpose of allowing air to pass into the cartridge while ink is sprayed out, they are not particularly well suited for passing ink into the cartridge. The present practice of recharging ink cartridges, therefore, is typically a messy, inefficient process.

It is therefore an object of the present invention to provide a device for improving the present practice of recharging ink cartridges. It is anther object of the invention to provide a kit for recharging ink cartridges that allows cartridges to be recharged with less ink spillage, and hence more economy, than known methods. It is still another object of the invention to provide an improved method for recharging ink cartridges.

SUMMARY OF THE INVENTION

These and other objects of the invention are achieved by the present invention which, in one aspect, features a device for clearing a hole in an ink cartridge having an interior reservoir to facilitate the refilling thereof. The device comprises a bit rigidly affixed to a handle so that torque applied to the handle is transmitted to the bit. The bit extends coaxially along the handle's longitudinal axis. The bit defines a sharpened tip and helical ridges to facilitate the hole clearing operation.

The handle of the invention defines a surface disposed about the longitudinal axis for receiving torque. In one embodiment of the invention the surface is contoured so that it can be easily gripped by a user. The surface can be cylindrical, frustum shaped, or any other configuration that is well suited for receiving torque.

In another aspect, the invention features a kit for refilling an ink cartridge. The kit includes, in addition to the hole-clearing device described above, a container which contains a fresh charge of ink. The container also includes a nozzle which is suitable for passing through a hole cleared by the hole-clearing device and which facilitates the delivery of ink to the cartridge with minimal, if any, spillage. In a particularly advantageous embodiment of this aspect of the invention, the container is compressible so that applying pressure to the container increases the rate at which ink is dispensed to the cartridge.

In still another aspect the invention features a method for refilling an ink cartridge with a fresh charge of ink. The method includes the steps of clearing a hole with the above described hole clearing device and dispensing a charge of ink to the cartridge through the cleared hole. The dispensing step can be carried out by utilizing an ink charge container as described above.

In accordance with the various aspects of the invention, therefore, a method and apparatus for refilling an ink cartridge are provided that are simpler and more efficient than known methods and apparatus. The hole clearing device and ink charge container of the invention require little skill to operate yet markedly improve the efficiency of the refilling operation.

These and other features of the invention will be more fully appreciated by reference to the following detailed description which is to be read in conjunction with the attached drawing.

DETAILED DESCRIPTION

In its broadest aspects, the present invention features a method and apparatus for refilling an ink cartridge. The invention provides a device, including a handle and a bit, for clearing a hole in an ink cartridge through which a fresh charge of ink can be dispensed to the cartridge.

Figure 1:
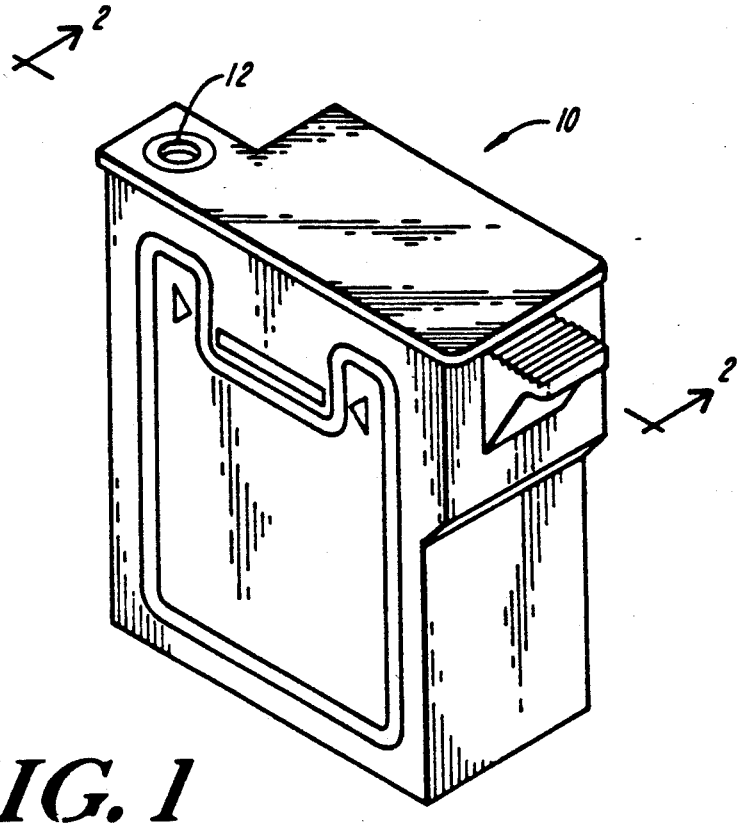
FIG. 1 is a perspective view of an ink cartridge in conjunction with which the present invention is suitable for use.

In FIG. 1 there is shown a perspective view of an exemplary ink cartridge 10 in conjunction with which the present invention is used. The ink cartridge 10 defines an interior reservoir 11, shown in FIGS. 2A through 2D, and includes a breather port 12 for allowing air to enter the interior reservoir 11 as ink is dispensed therefrom. This breather element improves the outflow of ink and thereby improves print quality.

Since, however, the breather port 12 is typically designed only for allowing the inflow of air, it is not well suited as a port through which ink can be dispensed to the interior reservoir 11. This is because the breather port 12 is typically spanned by a web 14 as shown in FIG. 2A.

Figure 2A:
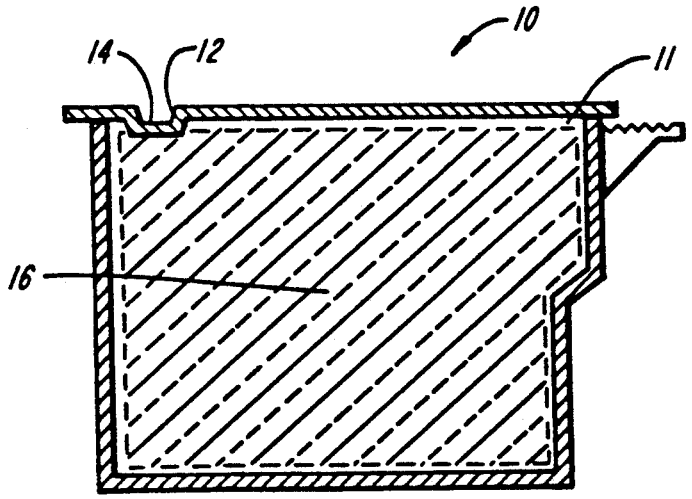
FIGS. 2A through 2D are cross section views taken along line 2—2 of FIG. 1.

Also shown in FIG. 2A is that disposed in the interior reservoir 11 is an ink absorbing sponge 16. The sponge prevents ink from splashing around inside of the cartridge while the cartridge moves back and forth in its printer harness during printing. The sponge does not prevent ink from spraying out the cartridge's jets (not shown) during the printing operation. This construction of ink cartridges is generally known in the art.

Figure 3:
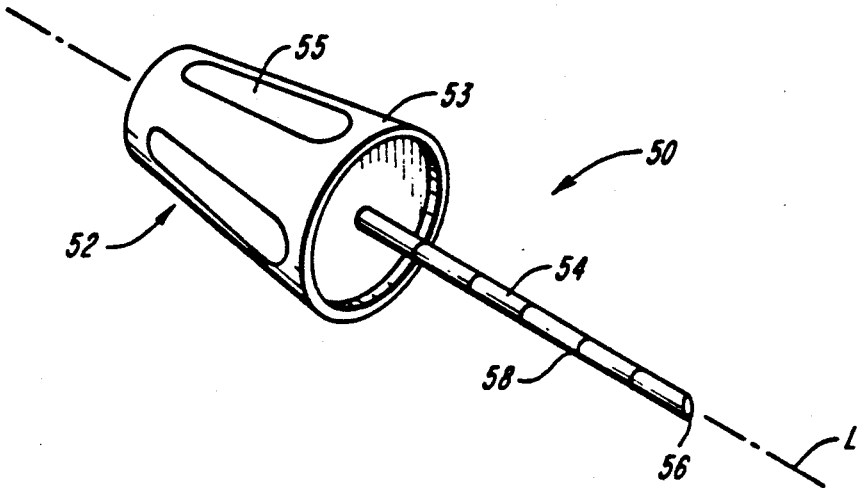
FIG. 3 is a perspective view of a hole clearing device constructed in accordance with the teachings of the present invention.
Figure 3A:
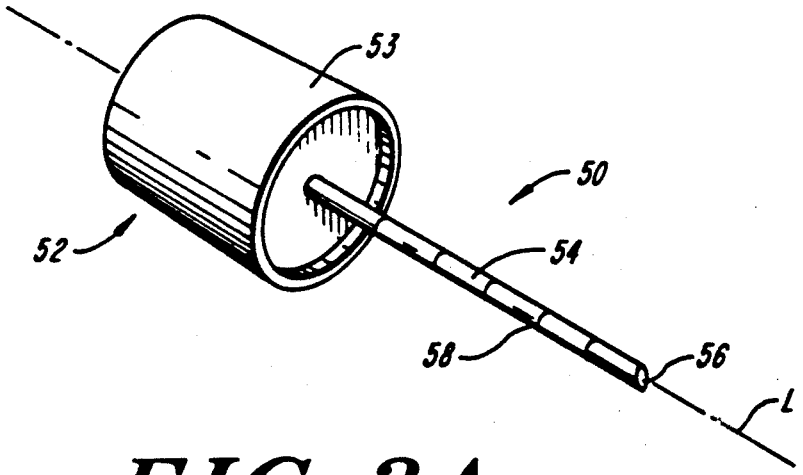
FIG. 3A is a perspective view of an alternative hole clearing device constructed in accordance with the present invention

The web 14 allows air to pass through the breather port 12 into the interior reservoir but impedes the delivery of ink therethrough. To clear a channel for the efficient delivery of ink, therefore, a drill 50 such as is shown in FIG. 3 is necessary. The drill 50 includes a handle 52, having a longitudinal axis L, and a bit 54. The bit 54 is rigidly affixed to the handle 52 in a manner generally known in the art and extends coaxially along the longitudinal axis L. As a result, torque applied to the handle 52 is transmitted to the bit 54. The handle 52 defines a surface 53 disposed about the longitudinal axis L which is formed to facilitate the application of torque to the handle 52. In one embodiment, the surface 53 of the handle 52 is provided with contours 55 for improved gripping. The overall configuration of the surface 53 can be cylindrical, frustum shaped, or any other shape that allows the device 50 to be easily manipulated. FIG. 3 shows a drill 50 having a frustum shaped handle 52 and FIG. 3A shows a drill 50 having a cylindrical shaped handle 52. The bit 54 includes a sharpened tip 56 and helical ridges 58 for improving the bit's ability to clear a hole in the breather port 12.

Figure 2B:
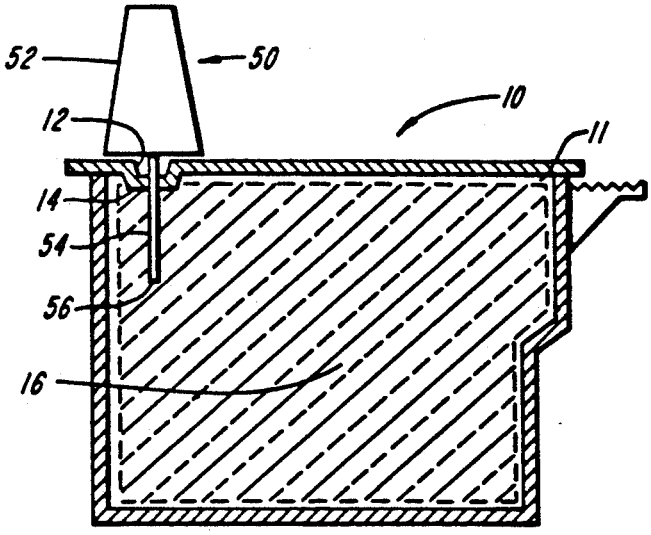

FIG. 2B shows how the drill 50 is utilized to clear a hole in the breather port 12. By pressing the tip 56 against the web 14 and applying torque to the handle 52, a user can clear the breather port 12 of the web 14. This is, in effect, a combination drilling and reaming action. It should be understood, however, that depending on the thickness of the web 14 it may not be necessary to apply a torque to the handle 52 for hole clearing. That is, in the case of a thin web it might be possible to clear a hole in the breather port simply by pushing the bit 54 through the port without applying a torque thereto. Also, for ink cartridges not having breather ports, a hole can be cleared utilizing the drill 50 simply by pressing the tip 56 against a sidewall of the cartridge. In this case, torque will almost certainly be required to help drive the bit 54 through the cartridge sidewall.

Figure 2C:
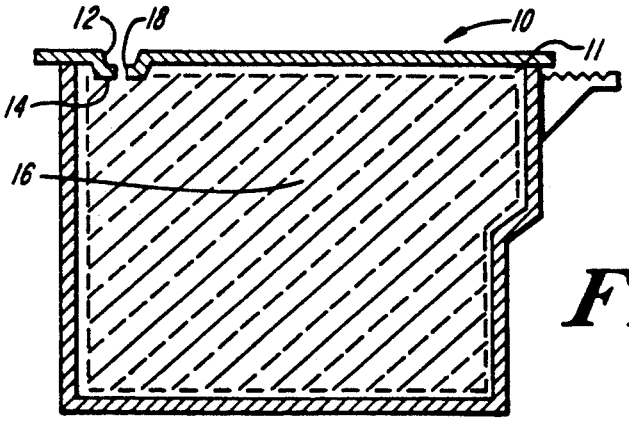
Figure 2D:
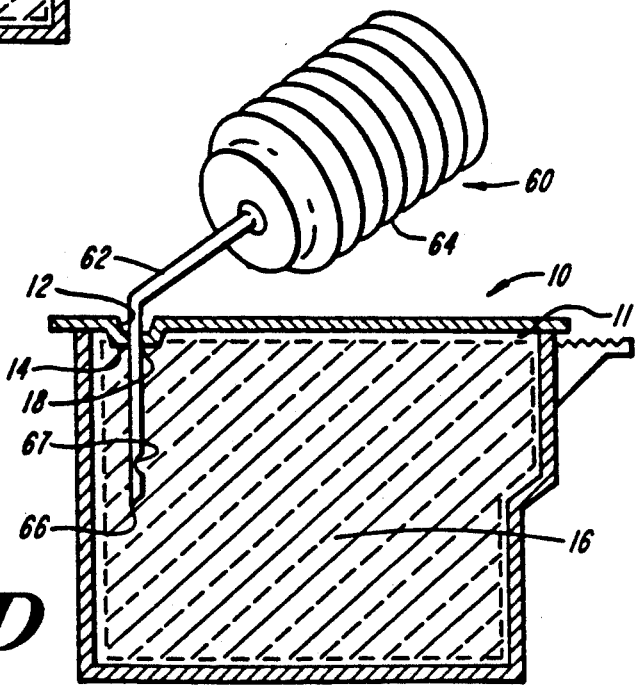

FIG. 2C shows the breather port 12 after the hole clearing operation. A hole 18 is now provided in the web 14 so that ink can be efficiently delivered to the sponge 16. FIG. 2D depicts a preferred method for carrying out this operation. In the figure, a container 60 is shown which includes a bellows 64 and a nozzle 62. Ink (not shown) is contained within the container bellows 64. In accordance with the invention, once the drill 50 has been used to clear a hole 18 in the web 14 of the breather port 12, the nozzle 62 is inserted through the hole 18. The nozzle 62 can be provided with an angled tip 66 or a hole 67 arranged in the side of the nozzle 66 to facilitate the passing of the nozzle 62 through the sponge 16 as well as the delivery of ink thereto.

In a preferred embodiment of the invention, the reservoir 64 is compressible. This enables a user to speed the flow of ink from the container 60 to the ink cartridge 10 by compressing the bellows 64.

Figure 4:
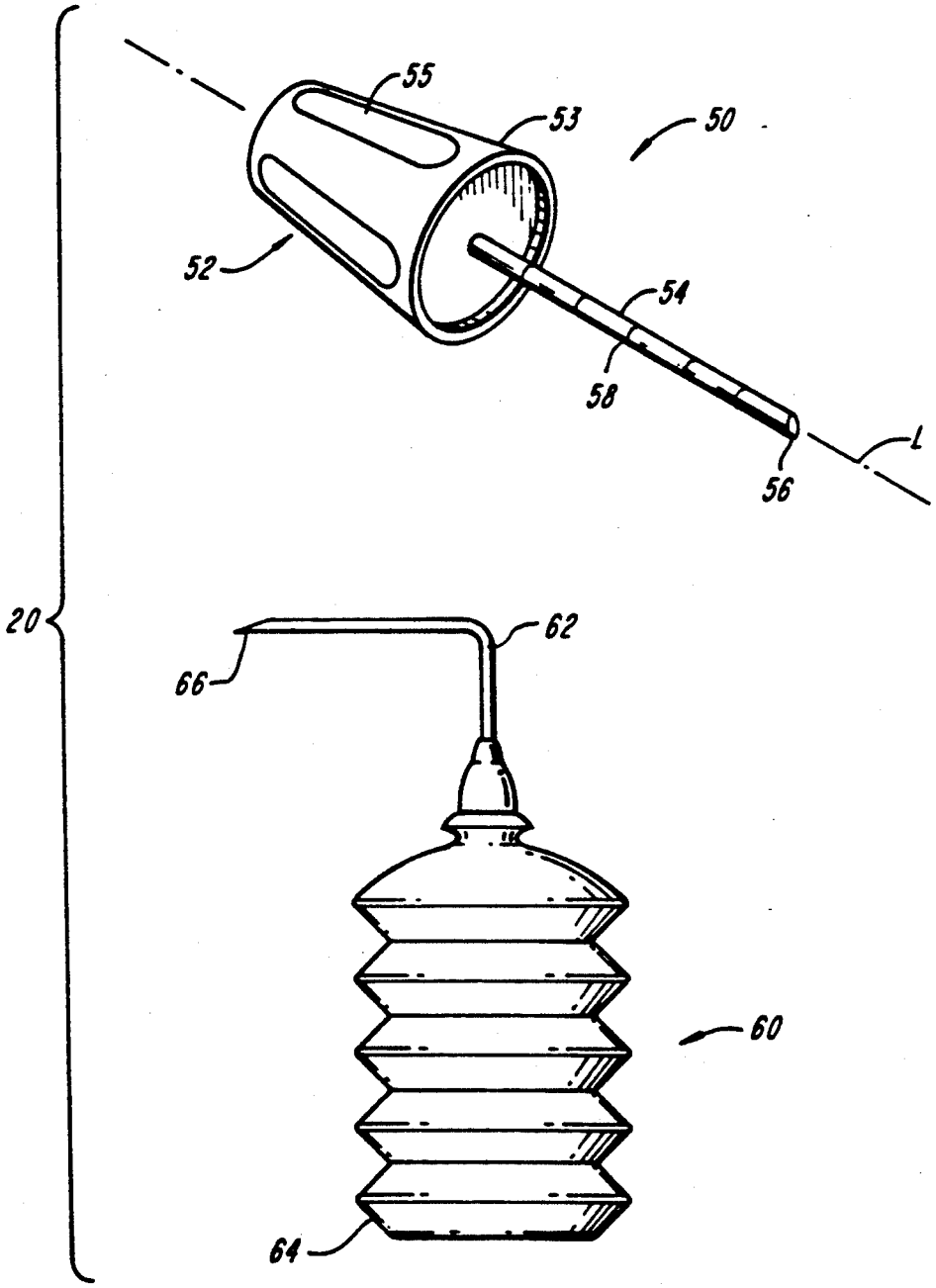
FIG. 4 shows a kit in accordance with the present invention.

FIG. 4 shows a kit 70 for refilling an ink cartridge 10, where the kit 70 includes a hole clearing device 50 and an ink container 60.

By use of the present invention, therefore, it is possible to the extend the life of an ink cartridge by recharging it with ink when its original supply of ink has been exhausted. For refills subsequent to the first refill, it will not be necessary to use the drill 50 because the web 14 will have been cleared for the first refill. Typically, therefore, the drill 50 will be discarded after the first refilling operation.

Other alterations to the above-described embodiments will be readily apparent to those ordinarily skilled in the art and are intended to be embraced within the spirit and scope of the invention. That is, the above description is intended as illustrative rather than limiting. The invention is to be defined, therefore, not by the preceding description but by the claims that follow.

What is claimed is:

1. A method for refilling an ink cartridge with ink, the method comprising the steps of providing a device for clearing a hole in an ink cartridge, the device comprising a handle having a longitudinal axis and defining a lateral surface disposed about said longitudinal axis for receiving torque, and a bit rigidly affixed to said handle and extending coaxially along said longitudinal axis, so that torque applied to said surface about said axis is transmitted to the bit, the bit defining a tip, distal to the handle, for clearing the hole, clearing a hole in the ink cartridge by pressing the tip of the bit against a sidewall of the cartridge and applying torque to the handle, and dispensing ink through the hole and into the cartridge.

2. A method as set forth in claim 1 wherein said dispensing step is performed by providing a container containing ink and having a nozzle, inserting the nozzle through the hole and into the cartridge, and compressing the container to force the contained ink out of the container, through the nozzle, and into the cartridge.

3. A kit for refilling an ink cartridge with ink, said cartridge including an interior ink reservoir, the kit comprising A. a device for clearing a hole in said ink cartridge, said hole extending into said interior ink reservoir, the device comprising, a handle having a longitudinal axis and defining a lateral surface disposed about said longitudinal axis for receiving torque, and a bit rigidly affixed to said handle and extending coaxially along said longitudinal axis, so that torque applied to said surface about said axis is transmitted to the bit, the bit defining a tip, distal to the handle, for clearing a hole in the cartridge, and B. a container containing ink and having a nozzle for dispensing the contained ink through the cleared hole into the ink cartridge.

4. A kit as set forth in claim 3 wherein said surface is contoured to facilitate the application of torque thereto.

5. A kit as set forth in claim 3 wherein said handle is cylindrically shaped.

6. A kit as set forth in claim 3 wherein said lateral surface of said handle is frustum shaped.

7. A kit as set forth in claim 3 wherein said lateral surface of said container is compressible.

8. A kit as set forth in claim 7 wherein said container is bellows-shaped and said nozzle extends from one end thereof.

9. A kit for refilling an ink cartridge with ink, said cartridge including an interior ink reservoir, the kit comprising A. a device for clearing a hole in said ink cartridge, said hole extending into said interior ink reservoir, the device comprising, a handle having a longitudinal axis and defining a lateral surface disposed about said longitudinal axis for receiving torque, and an elongated piercing element affixed to said handle and extending coaxially along said longitudinal axis, so that force applied to said surface along said axis is transmitted to the piercing element, the piercing element defining a tip, distal to the handle, for clearing a hole in the cartridge, and B. a container containing ink and having a nozzle for dispensing the contained ink through the cleared hole into the ink cartridge.

10. A kit as set forth in claim 9 wherein said surface is contoured to facilitate the application of torque thereto.

11. A kit as set forth in claim 9 wherein said handle is cylindrically shaped.

12. A kit as set forth in claim 9 wherein said lateral surface of said handle is frustum shaped.

13. A kit as set forth in claim 9 wherein said lateral surface of said container is compressible.

14. A kit as set forth in claim 13 wherein said container is bellows-shaped and said nozzle extends from one end thereof.

15. A method for refilling an ink cartridge with ink, the method comprising the steps of A. providing a device for clearing a hole in an ink cartridge, the device comprising a handle having a longitudinal axis and defining a lateral surface disposed about said longitudinal axis for receiving torque, and a elongated piercing element rigidly affixed to said handle and extending coaxially along said longitudinal axis, so that force applied to said surface along said axis is transmitted to the piercing element, the piercing element defining a tip, distal to the handle, for clearing the hole, B. clearing a hole in the ink cartridge by pressing the tip of the piercing element against a wall of the cartridge and applying axial force to the handle, and C. dispensing ink through the hole and into the cartridge.

16. A method as set forth in claim 15 wherein said dispensing step is performed by providing a container containing ink and having a nozzle, inserting the nozzle through the hole and into the cartridge, and compressing the container, to force the contained ink out of the container, through the nozzle, and into the cartridge.

* * * * *

US005199470B1

REEXAMINATION CERTIFICATE (2882nd)

United States Patent [19]

Goldman

[11] B1 5,199,470

[45] Certificate Issued May 14, 1996

[54] METHOD AND APPARATUS FOR REFILLING INK CARTRIDGES

[75] Inventor: Barry M. Goldman, Waltham, Mass.

[73] Assignee: Graphic Utilities, Inc., Waltham, Mass.

Reexamination Request:
No. 90/003,676, Dec. 28, 1994

Reexamination Certificate for:

| | |
|---|---|
| Patent No.: | **5,199,470** |
| Issued: | **Apr. 6, 1993** |
| Appl. No.: | **702,081** |
| Filed: | **May 17, 1991** |

[51] Int. Cl.[6] ..... B65B 3/30

[52] U.S. Cl. ..... 141/1; 141/98; 141/2; 141/26; 206/223; 30/368; 401/198; 401/199; 401/217

[58] Field of Search ..... 141/1, 2, 21, 25, 141/98, 329; 30/366, 368; 408/712, 129, 239 R; 206/223; 347/85–87

[56] References Cited

U.S. PATENT DOCUMENTS

| | | | |
|---|---|---|---|
| 1,124,663 | 1/1915 | Sawyer | 408/712 X |
| 1,596,646 | 8/1926 | Yeldell | 408/239 R |
| 2,390,309 | 12/1945 | Keys | 30/368 X |
| 4,161,178 | 7/1979 | Genese | 141/329 X |
| 4,162,501 | 7/1979 | Mitchell et al. | 347/86 |
| 4,347,874 | 9/1982 | Sullivan et al. | 141/329 X |
| 4,607,671 | 8/1986 | Aalto et al. | 141/329 X |
| 4,700,202 | 10/1987 | Kuranishi et al. | 347/86 |
| 4,923,341 | 5/1990 | Cameron | 408/712 X |
| 5,067,532 | 11/1991 | Lang et al. | 141/329 |
| 5,329,294 | 7/1994 | Ontawar et al. | 347/87 |

OTHER PUBLICATIONS

General Metals, by John L. Feirer, 1952, Unit 12.

First Lessons in Metal–Working, by Alfred G. Compton, 1894, pp. 128–130.

The Practice of Hand–Turning, by Francis Campin, 1861, p. 72.

Grove Enterprises, Inc., Copyright No. TX 2–548–161; "Procedure for Modifying a Deskjet Cartridge for Re–Inking"; Apr. 7, 1989.

*Primary Examiner*—J. Casimer Jacyna

[57] ABSTRACT

A method and apparatus for refilling an ink cartridge include a device for clearing a hole in the cartridge to facilitate the dispensing of ink thereto. The device comprises a handle to which a bit is rigidly affixed so that torque applied to the handle is transmitted to the bit. The bit is arranged to extend along the handle's longitudinal axis. A kit for refilling an ink cartridge includes the aforementioned hole clearing device and a container containing a charge of ink and having a nozzle. The nozzle is formed so that it can pass through the hole cleared by the hole clearing device. In a preferred embodiment, the container is bellows shaped and compressible so that a user can compress the container and increase the rate at which the fresh ink charge is dispensed to the cartridge.

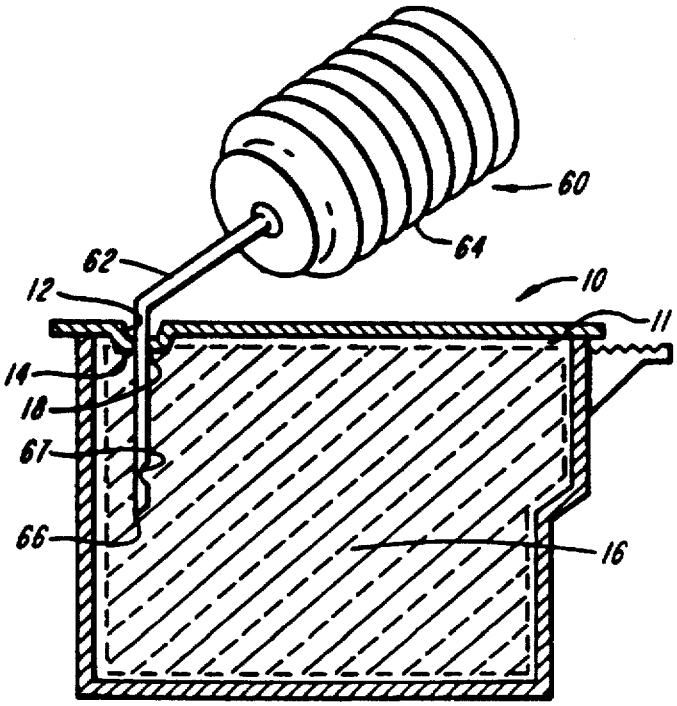

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–16 are cancelled.

* * * * *